US011498102B2

(12) United States Patent
Pinosa

(10) Patent No.: US 11,498,102 B2
(45) Date of Patent: Nov. 15, 2022

(54) DRAWING CARRIAGE FOR A DRAWING MACHINE, AND DRAWING MACHINE

(71) Applicant: EJP Maschinen GmbH, Baesweiler (DE)

(72) Inventor: Ottavio Pinosa, Martignacco (IT)

(73) Assignee: EJP Maschinen GmbH

( * ) Notice: Subject to any disclaimer, the term of this patent is extended or adjusted under 35 U.S.C. 154(b) by 1 day.

(21) Appl. No.: 16/320,170

(22) PCT Filed: Jul. 25, 2017

(86) PCT No.: PCT/DE2017/100620
§ 371 (c)(1),
(2) Date: Jan. 24, 2019

(87) PCT Pub. No.: WO2018/019335
PCT Pub. Date: Feb. 1, 2018

(65) Prior Publication Data

US 2019/0224733 A1 Jul. 25, 2019

(30) Foreign Application Priority Data

Jul. 25, 2016 (DE) ..... 102016113686.7

(51) Int. Cl.
*B21C 1/28* (2006.01)
*B21C 1/30* (2006.01)

(52) U.S. Cl.
CPC . *B21C 1/28* (2013.01); *B21C 1/30* (2013.01)

(58) Field of Classification Search
CPC .. B21C 1/28; B21C 1/30; B21C 1/305; B21C 1/27; B21C 1/16; B21D 43/02;
(Continued)

(56) References Cited

U.S. PATENT DOCUMENTS 4,879,892 A * 11/1989 Paraskevas ..... B21C 1/28 72/290
6,688,152 B2 * 2/2004 Klingen ..... B21C 1/16 72/278
(Continued)

FOREIGN PATENT DOCUMENTS

CN 1250353 C 4/2006
CN 201493329 U 6/2010
(Continued)

OTHER PUBLICATIONS

Translation of CN-103447327-A (Year: 2013).*
(Continued)

*Primary Examiner* — Shelley M Self
*Assistant Examiner* — Teresa A Guthrie
(74) *Attorney, Agent, or Firm* — Williams Mullen; Thomas F. Bergert

(57) ABSTRACT

A drawing carriage for a drawing machine, comprising two clamping jaws (16) and a clamping jaw moving device for an opening and closing movement of the clamping jaws (16), is characterized in that the clamping jaw moving device comprises a linear motor (4). In the case of a drawing machine, comprising a drive unit for driving at least two drawing carriages (1), the drawing carriages (1) have a linear motor (4) for the clamping jaw moving device.

7 Claims, 4 Drawing Sheets

(58) Field of Classification Search
CPC ..... B21D 43/006; B21D 43/10; B21D 43/11; B25B 1/18; B25B 5/166
USPC ..... 72/290; 269/43, 45, 246, 291
See application file for complete search history.

(56) References Cited

U.S. PATENT DOCUMENTS

| | | | | |
|---|---|---|---|---|
| 6,715,332 | B2 * | 4/2004 | Klingen | B21C 1/20 72/291 |
| 6,953,136 | B2 * | 10/2005 | Paraskevas | B21C 1/28 226/168 |
| 7,275,405 | B2 * | 10/2007 | Bultmann | B21C 1/30 226/112 |
| 2015/0273747 | A1 | 10/2015 | Montes de Oca Balderas et al. | |

FOREIGN PATENT DOCUMENTS

| | | | | |
|---|---|---|---|---|
| CN | 102161056 | A | 8/2011 | |
| CN | 103447327 | A * | 12/2013 | |
| CN | 103447327 | A | 12/2013 | |
| DE | 897237 | | 11/1953 | |
| DE | 932766 | | 9/1955 | |
| DE | 3005371 | | 8/1981 | |
| DE | 3005371 | A1 * | 8/1981 | B21C 1/22 |
| DE | 3130820 | C1 | 8/1983 | |
| DE | 3729892 | | 3/1989 | |
| DE | 3823134 | C1 | 4/1989 | |
| DE | 10122657 | | 11/2002 | |
| EP | 1938912 | A1 | 7/2008 | |
| JP | 2004025310 | | 1/2004 | |
| KR | 10-0848536 | | 7/2008 | |
| KR | 10-2009-0085001 | | 8/2009 | |

OTHER PUBLICATIONS

International Preliminary Report and Written Opinion for PCT/DE2017/100620, European Patent Office, dated Jun. 25, 2018.
International Search Report for PCT/DE2017/100620, European Patent Office, dated Nov. 23, 2017.
Intellectual Property Office of India, Office Action for IN Application No. 201947002958, dated Jan. 29, 2021.
Chinese Patent Office, Office Action for CN Application 201780058624.0, dated Dec. 10, 2019.
Chinese Patent Office, Office Action for CN Application 201780058624.0, dated Oct. 4, 2020.
KR Office Action, Korean Intellectual Property Office, KR Patent Application No. 10-2019-7005322, dated Apr. 5, 2021.
JP Office Action, Japanese Patent Office, JP Application No. 2019-504946, dated May 18, 2021.
Notice of Allowance, China National Intellectual Property Administration, CN Patent Application No. 2017800586240, dated Apr. 1, 2021.

* cited by examiner

DRAWING CARRIAGE FOR A DRAWING MACHINE, AND DRAWING MACHINE

CROSS-REFERENCE TO RELATED APPLICATIONS

This application is the U.S. National Stage of International Application PCT/DE2017/100620, filed Jul. 25, 2017, which claims the benefit of German Patent Application 10 2016 113 686.7 of Jul. 25, 2016; all of which are hereby incorporated herein in their entirety by reference.

The invention concerns a drawing carriage for a drawing machine in accordance with the preamble of claim 1 as well as a drawing machine in accordance with the preamble of claim 4.

Drawing machines are used to draw elongate metal objects, such as rods or pipes through a drawing tool. It is by means of the drawing tool that the metal objects are given a desired peripheral shape.

A drawing carriage as well as a drawing machine of the kind mentioned at the beginning are known from DE 932 786 B. A plurality of drawing carriages are moved in circles on a continuous chain of the drawing machine, with the drawing carriages alternately grasping the material to be drawn by means of clamping jaws and pulling it through the drawing tool along a drawing path. In one embodiment, the clamping jaws are closed and opened in a purely mechanical way, in that levers interacting with the clamping jaws are actuated automatically by way of stops disposed at the drawing bench. The drawing carriage swinging into the drawing path from the return path under the drawing path has open clamping jaws which take hold of the material to be drawn between them. The first stop collaborates with the closing lever and causes the clamping jaws to close. At the end of the drawing path, a second stop causes the clamping jaws to open so that the drawing carriage can be led back. In an alternative version, two solenoids are used, one of which is responsible for the closing motion and the other one is responsible for the opening motion. The solenoids respectively actuate the opening/closing levers in a stroke-like manner by way of jointed rods, with the power being supplied by way of sliding contacts.

DE 101 22 657 A1 discloses a drawing unit for a drawing machine, which comprises a drawing carriage of the kind mentioned at the beginning. The drawing machine according to the state of the art can operate continuously, in that a plurality of drawing carriages are present and it draws the material to be drawn in hand-to-hand operation. The periodic movement of the, e.g. two drawing carriages is then coordinated in such a way that a first drawing carriage grasps and draws the material to be drawn, while the second drawing carriage returns to an initial position in order to grasp the material to be drawn. When the second drawing carriage starts with the drawing process, the first drawing carriage has already disengaged from the material to be drawn and returns in turn to its initial position in order to again grasp and draw the material to be drawn. The movement of the drawing carriages parallel to the drawing direction can, e.g. be provided by means of a rotating drum having ridges running on a curvilinear path on the surface of the drum or by means of linear motors (see DE 37 29 892 A1).

The known drawing carriages have clamping jaws for grabbing the material to be drawn. The clamping jaws are directly or indirectly positioned at wedge-shaped guides, so that a self-locking clamping operation takes place during the drawing process. The manner of opening and closing the clamps is not explicitly disclosed. However pneumatic or hydraulic clamping is usually provided. Such hydraulic or pneumatic systems are more reliable than purely mechanical systems and react very quickly, but have the disadvantage that they must be set very precisely to the ideal closing and opening time.

It is now an object of the present invention to make available a drawing carriage and a drawing machine of the kind mentioned at the beginning, which have an alternative clamping jaw moving device for the opening and closing movements of the clamping jaws as compared to the state of the art.

This object is achieved by means of a drawing carriage of the kind mentioned at the beginning by way of the characterizing features of claim 1 and by means of a drawing machine of the kind mentioned at the beginning by way of the characterizing feature of claim 5.

A linear motor for the opening and closing movement of the clamping jaws is less costly in comparison with the pneumatic or hydraulic solution or in comparison with the use of two solenoids in accordance with the state of the art. It is thus possible to do without mechanical components, whereby maintenance costs can be reduced. No mechanical setting of the clamping jaws is needed. Moreover, the clamping jaws can be positioned more accurately by a linear motor and the response time of the system is shorter. In addition, the effect of temperature on the system is reduced or can be completely disregarded. In comparison with an electric motor having a rotary drive as an alternative, a considerable benefit lies in the fact that a conversion of a rotational to a translational movement by means of the gear mechanisms as required for this is not required.

In the case of a drawing machine in which at least two drawing carriages grab the material to be drawn, e.g. a bar-shaped material, in particular for the production of wires, alternately in hand-to-hand operation, the proper adjustment of the clamping jaw movement is important. The translational movement of the respective carriage and the closing and/or opening movement of the clamping jaws must, in particular, be precisely coordinated, e.g. to avoid slippage of the material to be drawn in the drawing carriage because the clamping jaws close too late, or buckling because the clamping jaws close too early. Such a coordination or synchronization is e.g. achieved by determining the position of the drawing carriage, e.g. by monitoring a drive means for the drawing carriage.

It is thus possible for the at least one drawing carriage to be driven over drive cams consisting of curved ridges of a rotary drive unit, e.g. a drive shaft. The curved ridge provided for a drawing carriage is grasped by this drawing carriage, whereby the drawing carriage is forced to undergo a translational back and forth motion. The drive unit can be configured so that the position of the drawing carriage at a given rotational position of the drive unit is unequivocal. It is thus possible to determine the moment at which the linear motor moves the clamping jaws of the drawing carriage to open or close from the rotational position of the drive unit, which can, e.g. be determined by way of a rotational position encoder. The position of the drawing carriage can of course alternatively be monitored directly, e.g. by means of visual or electrical sensors.

The dependent claims set out other advantageous embodiments.

An advantageous variant of the drawing carriage, as well as an example embodiment of the drawing machine is described in the following by way of example using figures, in which.

Figure 1:
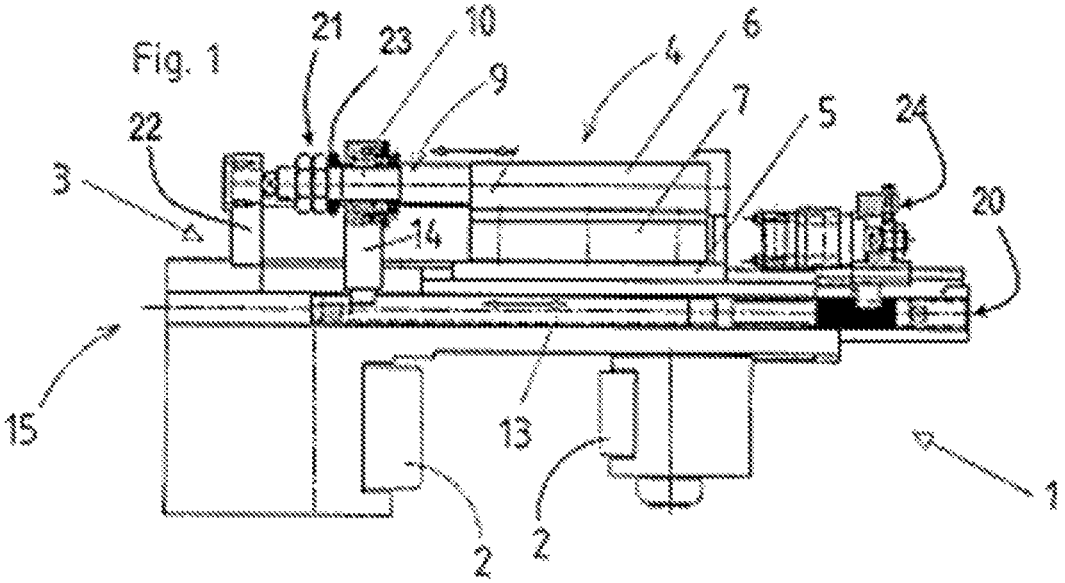
FIG. 1 is a side view of the drawing carriage having a linear motor.
Figure 3:
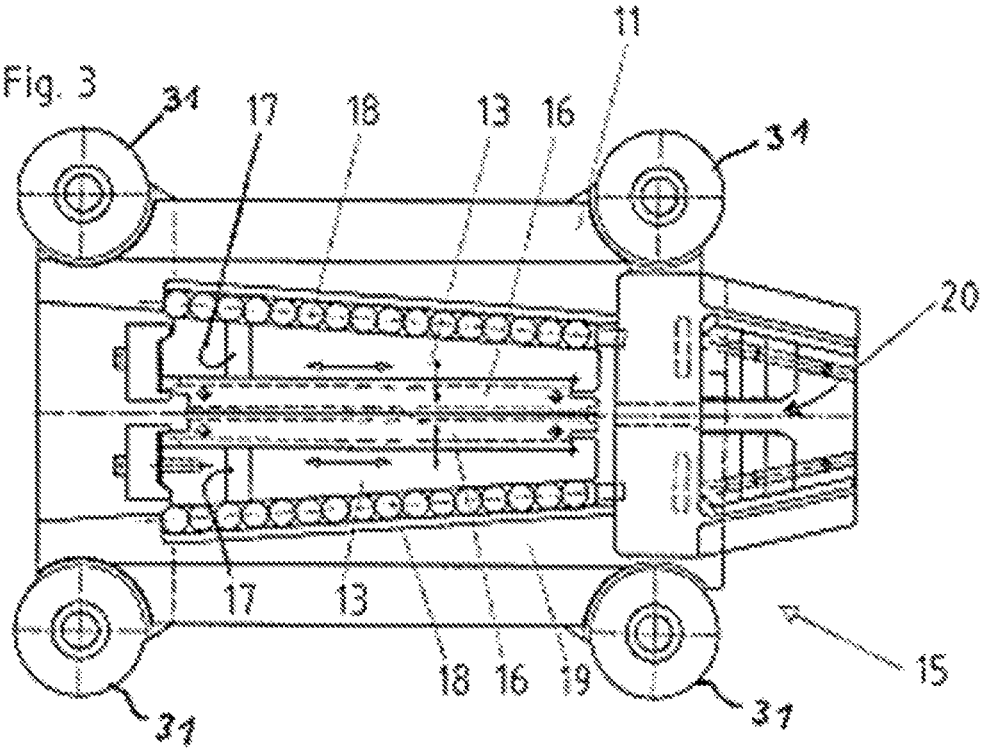
Figure 4:
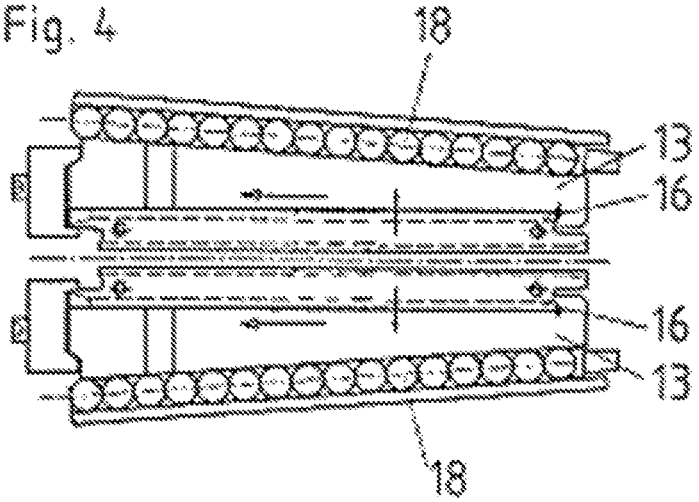
Figure 5:
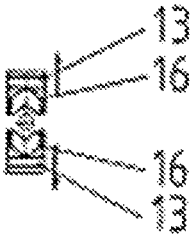
Figure 6:
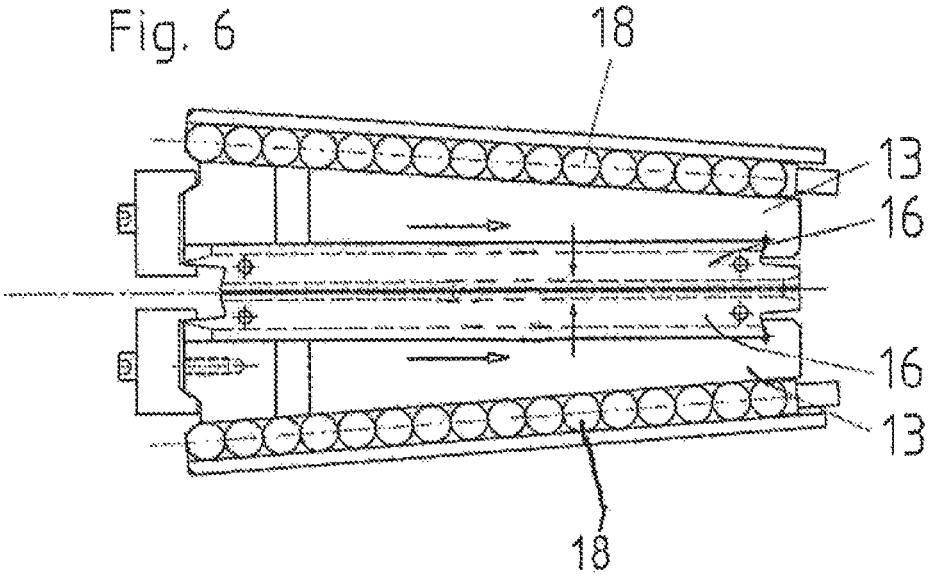
Figure 7:
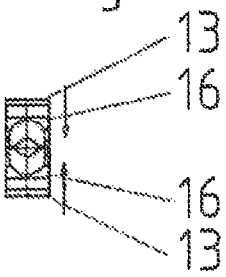
Figure 8:
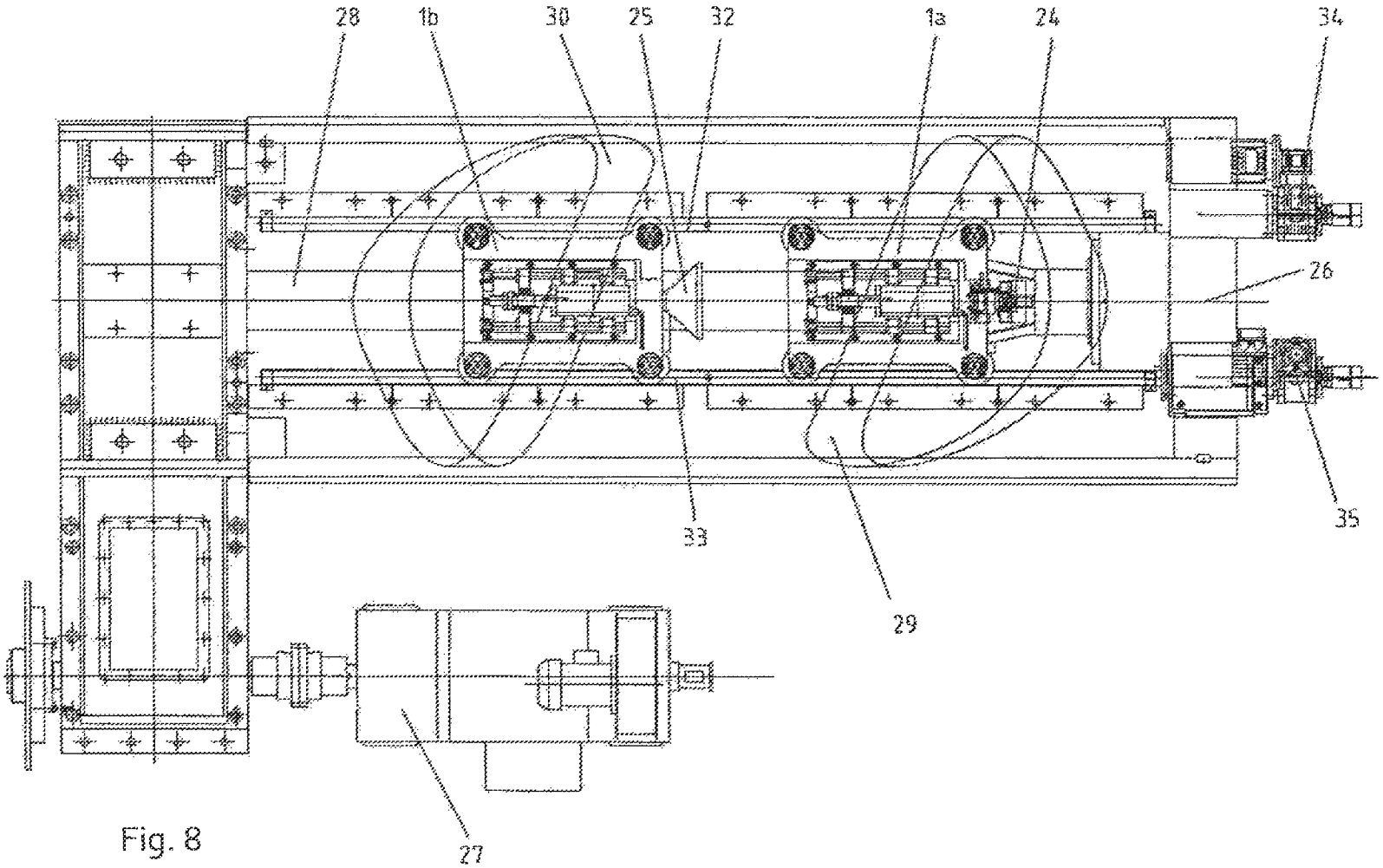

FIG. 3 shows a lower part of the drawing carriage in accordance with FIG. 1 without the attachment for the linear motor, FIG. 4 shows a clamping mechanism of the drawing carriage in the open state, FIG. 5 is a side view of the front of the clamping jaws in the open state, FIG. 6 is a top view of the clamping jaws in accordance with FIG. 4 in the closed state, FIG. 7 is a side view of the clamping jaws in the closed state, and FIG. 8 is a top view of the drawing machine.

FIG. 1 is a side view of a drawing carriage 1 for a drawing machine (not shown here). To accomplish a translational propulsion of the drawing carriage 1 parallel to a longitudinal axis 26 (see FIG. 8), the drawing carriage 1 grasps a drive ridge (not shown in FIG. 1), which rotates about the longitudinal axis 26 and defines a drive cam. FIG. 8 shows the outlines of drive ridges 29 and 30, which are located on a drive shaft 28. Parts of the drive ridges 29 and 30 that are actually not visible in this view are also represented for purposes of better visualization. Drive ridge rollers 2 provide for low resistance during the relative motion between the drive ridge 30 and the drawing carriage 1. The drawing carriage is guided on the drawing machine (see FIG. 8) for purposes of translational motion, for which purposes translational motion rollers 31 (see FIGS. 2 and 3) are provided.

Figure 2:
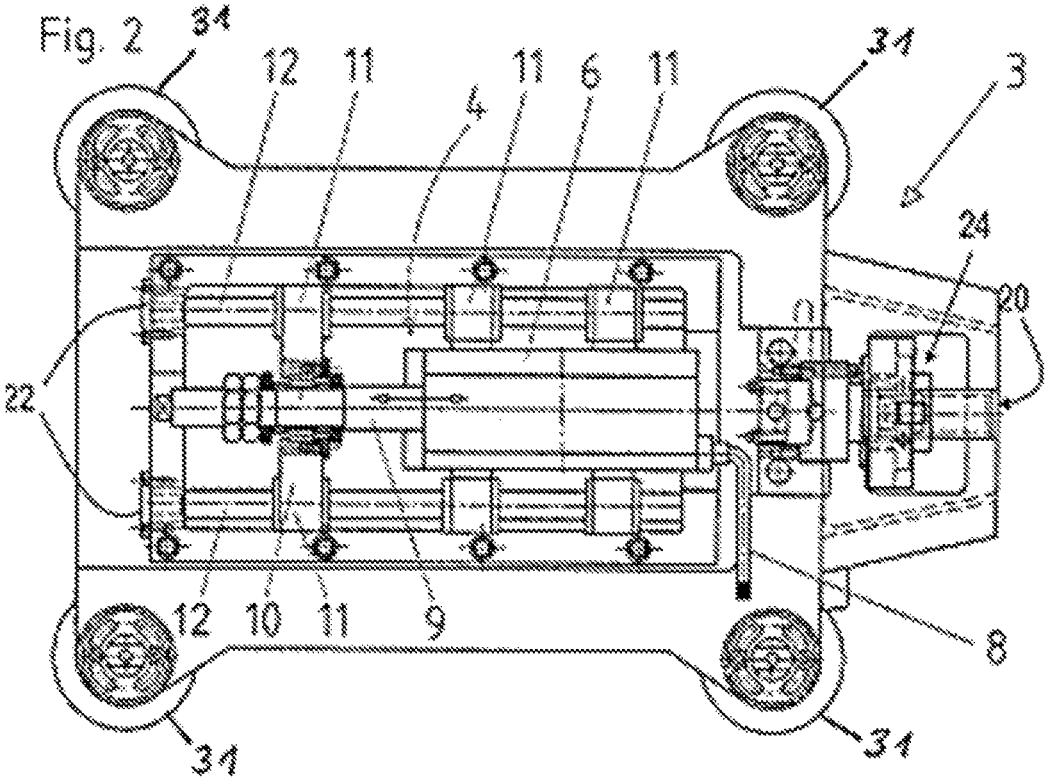
FIG. 2 is a top view of the drawing carriage in accordance with FIG. 1.

A linear motor 4 is arranged on an upper part 3 of the drawing carriage 1 shown in top view in FIG. 2, which motor comprises a stator part 5 (not shown in detail here) that has permanent magnets and is affixed to the upper part 3. A sliding carriage 6 acting as the mover part of the linear motor 4 comprises wire windings (not shown in detail here) in a lower sliding carriage part 7, which windings are supplied with electricity via an electrical supply 8 (see FIG. 2), in order to produce the desired linear motion. The sliding carriage 6 has a transmission rod 9 to which a bridge 10 is attached. The sliding carriage 6 and the bridge 10 are made to slide on guide rods 12 (only shown in FIG. 2) via sliding sleeves 11, so that only linear movements in the direction of the double arrow are possible and lateral deviations are prevented. The guide rods 12 are attached in rod holders 22.

FIG. 1 shows a clamping jaw holder 13 underneath the linear motor 4, with which an engagement rod 14 of the bridge 10 engages in an interlocking manner, so that the clamping jaw holder 13 along with the sliding carriage 6 carries out the desired linear movement in the direction of the double arrow. As will be set out in the description of FIG. 3, there are two engagement rods 14, i.e. one for each clamping jaw holder 13. To be able to align the clamping jaw holders 13 in the longitudinal direction of the transmission rod 9 relative to this transmission rod 9, optional adjusting nuts 21 can be provided, by which the engagement rods 14 can be set in their position on the transmission rod 9. It is in principle possible to do without such alignment options, since the position of the engagement rod 14 can also be corrected by means of the linear motor 4.

Similarly optional disk spring stacks 23 in FIGS. 1 and 2 on the right and the left of the bridge 10 cushion the movements during the opening and closing of the clamping jaws 16 in the area of the transmission rod 9. For the sake of clarity, only FIG. 1 marks a disk spring stack with a reference numeral, and only the left-hand disk spring stack 21 is marked therein.

FIG. 3 shows a lower part 15 of the drawing carriage 1 having two clamping jaws 16, which are each held by a clamping jaw holder 13. The clamping jaw holders 13 have respective engagement slots 17 for each of the engagement rods 14 to engage in. The clamping jaw holders 13 are mounted by means of ball bearings 18 on a wedge-shaped guide 19 of the lower part 15 of the drawing carriage. The clamping jaw holders 13 are moreover guided in such a way that on moving to the left (in FIG. 3) they execute an opening movement at right angles thereto. Upon moving to the right (in FIG. 3), the wedge-shaped guide 19 provides for a closing movement of the clamping jaw holders 13.

FIG. 4 shows the clamping jaw holders 13 and the clamping jaws 16 along with the ball bearing 18 in the open state. FIG. 5 is a side view of the clamping jaw holders 13 and the clamping jaws 16.

FIGS. 6 and 7 are a top view and a side view, respectively, of the structures in accordance with FIGS. 4 and 5, but in the closed state of the clamping jaws 16.

When the drawing carriage 1 has its clamping jaws 16 in the open state, it is detached from material to be drawn (not shown here) that has passed through the drawing carriage 1, or there is no material to be drawn in it. The material to be drawn can be introduced into the drawing carriage 1 via an inlet 20 for the material to be drawn. Optional feed-in pincers 24 can be used for this, which can, e.g. also be moved relative to the lower part 15 of the drawing carriage 1 by way of a linear motor (not shown in detail) and which draws in the material that is to be conveyed until it can be grasped by the clamping jaws 16. When the drawing carriage 1 is in the engaged position, the closed state is reached by means of the movement of the linear motor 4, as the clamping jaw holders 13 are displaced in the direction of the inlet 20 for the material to be drawn, i.e. to the right in FIGS. 1 to 4 and 6. When the entire drawing carriage 1 is thereafter moved in the drawing direction and the material to be drawn, e.g. a rod or a pipe, is thereby drawn, self-locking of the clamping is achieved by means of the wedge-shaped guide 19.

FIG. 8 shows a top view of a drawing machine having two drawing carriages 1*a* and 1*b*. The front drawing carriage 1*a* shows the drawing pincers 24 (see FIG. 1) for the material to be drawn (not shown here), while the rear drawing carriage has an inlet cone 25, which facilitates the transfer of the front end of the material to be drawn from the front drawing carriage 1*a* to the rear drawing carriage 1*b*. In order to drive the drawing carriages 1*a* and 1*b* in parallel with the longitudinal axis 26, a drive shaft 28 is rotated by means of a motor 27, e.g, an electric motor, and a gear means (not shown here). Two drive ridges 29 and 30, which are each grasped by one of the drawing carriages 1*a* and 1*b* and off which drive ridge rollers 2 (only shown in FIG. 1) roll, are disposed in a torque-proof manner on the drive shaft 28. The drawing carriages 1*a* and 1*b* are forced to carry out the desired translational movement by means of guides 32 and 33, along which the drawing carriages 1*a* and 1*b* are guided via translational motion rollers 31 (see FIGS. 2 and 3).

For the wire production operation, at the front end of the drawing machine (to the right in FIG. 8), the generally pointed material to be drawn (not shown here) is supplied to the feed-in pincers 24 of the front drawing carriage 1*a* after passing through a drawing die (not shown either). Alignment motors 34 and 35 can be provided for the correct alignment of the drawing die. The drive shaft 28 is subsequently turned, whereby the drawing carriages 1*a* and 1*b* are forced to move back and forth. The front drawing carriage 1*a* then first moves from right to left in FIG. 8. Before the drive cam forces the front drawing carriage 1*a* back to the right, the feed-in pincers 24 open and the front drawing carriage 1*a* then travels to the right again, with the clamping jaws 16 (see FIGS. 3 and 4) then open, so that the front drawing carriage 1*a* can then also grasp the material to be drawn with its clamping jaws 16. The feed-in pincers 24 can alternatively also be displaced relative to the clamping jaws, e.g. by means of another linear motor (not shown here), until the clamping jaws 16 can grasp the material to be drawn.

When the front drawing carriage 1*a* carrying the material to be drawn between the clamping jaws reaches its left hand position again, the material to be drawn is handed over to the second drawing carriage 1*b*, which executes a translational movement in the direction opposite to that of the drawing carriage 1*a*. The front drawing carriage 1*a* is thus in its rearmost position for the transfer of the material to be drawn, while the rear drawing carriage 1*b* assumes its front-most position. Therefore, exactly one of the two drawing carriages 1*a* or 1*b*, with closed clamping jaws 16, always pulls the material to be drawn to the left in FIG. 8, while the other drawing carriage 1*a* or 1*b* with open clamping jaws 16 returns to its front position.

| List of reference numerals |
|---|
| 1 drawing carriage |
| 2 drive ridge rollers |
| 3 upper part of the drawing carriage |
| 4 linear motor |
| 5 stator part |
| 6 sliding carriage |
| 7 lower sliding carriage part |
| 8 electrical supply |
| 9 transmission rod |
| 10 bridge |
| 11 sliding sleeve |
| 12 guide rod |
| 13 clamping jaw holders |
| 14 engagement rod |
| 15 lower part of the drawing carriage |
| 16 damping jaws |
| 17 engagement slots |
| 18 ball bearings |
| 19 wedge-shaped guide |
| 20 inlet for the material to be drawn |
| 21 adjusting nuts |
| 22 rod holders |
| 23 disk spring stack |
| 24 feed-in pincers |
| 25 inlet cone |
| 26 longitudinal axis |
| 27 motor |
| 28 drive shaft |

-continued

| List of reference numerals |
|---|
| 29 drive ridge |
| 30 drive ridge |
| 31 translational motion rollers |
| 32 guide |
| 33 guide |
| 34 alignment motor |
| 35 alignment motor |

The invention claimed is:

1. A drawing machine comprising a drive unit for driving at least two drawing carriages, wherein at least one of the drawing carriages comprises two clamping jaws and a clamping jaw moving device for an opening and closing movement of the clamping jaws, wherein the clamping jaw moving device comprises exactly one linear motor, the linear motor having a stator part directly affixed on the drawing carriage and a mover part that is directly arranged on the drawing carriage, wherein the mover part comprises a sliding carriage having a transmission rod and a bridge secured to the transmission rod, wherein the sliding carriage and bridge are linearly movable relative to the stator part by two guide rods arranged above the clamping jaws, the mover part directly or indirectly engaging the clamping jaws.

2. The drawing machine according to claim 1, wherein the drive unit has at least one drive cam which rotates about a longitudinal axis during operation and drives one of the drawing carriages into a translational movement parallel to the longitudinal axis.

3. The drawing machine according to claim 1, wherein the clamping jaw moving device is configured so as to displace the clamping jaws in the longitudinal direction of the drawing carriage.

4. The drawing machine according to claim 3, wherein the drive unit has at least one drive cam which rotates about a longitudinal axis during operation and drives one of the drawing carriages into a translational movement parallel to the longitudinal axis.

5. The drawing machine according to claim 1 further comprising a feed-in device for feeding in material to be drawn towards the clamping jaws, the feed-in device having a feed-in linear motor for the feed-in motion.

6. The drawing machine according to claim 5, wherein the drive unit has at least one drive cam which rotates about a longitudinal axis during operation and drives one of the drawing carriages into a translational movement parallel to the longitudinal axis.

7. The drawing machine according to claim 1, wherein the sliding carriage and bridge are slidable along the guide rods via sliding sleeves.

* * * * *